United States Patent [19]

Hill

[11] 4,175,780

[45] Nov. 27, 1979

[54] LATCH MECHANISM

[76] Inventor: Ulderic S. Hill, C.P. 68 Co. Stanstead, Rock Island, Quebec, Canada

[21] Appl. No.: 839,733

[22] Filed: Oct. 5, 1977

Related U.S. Application Data

[62] Division of Ser. No. 680,965, Apr. 27, 1976, Pat. No. 4,084,519.

[30] Foreign Application Priority Data

May 2, 1977 [CA] Canada ..... 277375

[51] Int. Cl.[2] ..... E05C 3/02

[52] U.S. Cl. ..... 292/201

[58] Field of Search ..... 292/201, 238, 231, 335, 292/336, 192

[56] References Cited

U.S. PATENT DOCUMENTS

| | | | |
|---|---|---|---|
| 459,080 | 9/1891 | Clark et al. | 292/238 |
| 2,808,918 | 10/1957 | Shepard, Jr. et al. | 292/201 |
| 2,828,990 | 4/1958 | Brown | 292/67 |
| 3,199,153 | 8/1965 | Weinstein | 292/201 X |
| 3,921,334 | 11/1975 | Black, Sr. | 292/192 |
| 3,921,494 | 11/1975 | Coe | 292/192 |
| 3,968,984 | 7/1976 | Guth | 292/336 X |

*Primary Examiner*—Richard E. Moore

[57] ABSTRACT

A latch mechanism adapted, for instance, to release a curtain for deployment by gravity along one side of a window to protect the latter against burglary. The latch mechanism comprises a latch finger rotatable about its longitudinal axis and including a latch pin portion pivoted at one end about a transverse axis to freely drop to a downwardly hanging released position upon appropriate rotation of the latch finger.

8 Claims, 5 Drawing Figures

LATCH MECHANISM

This is a division of U.S. Pat. application Ser. No. 680,965, filed Apr. 27, 1976 now U.S. Pat. No. 4,084,519, issued Apr. 18, 1978.

It is the main object of the present invention to provide a latching mechanism which operates upon loss of vacuum or pressure in an enclosed space, such as between spaced-apart window panes, and which requires a very small triggering force to trip to releasing position.

This invention relates to a latch mechanism which is advantageously adapted to release a shielding curtain for deployment thereof along one side of a window but which is also adapted for other latching applications.

The above and other objects and advantages of the present invention will be better understood with the following detailed description of a preferred embodiment thereof which is illustrated, by way of example, in the accompanying drawings, wherein.

Figure 1:
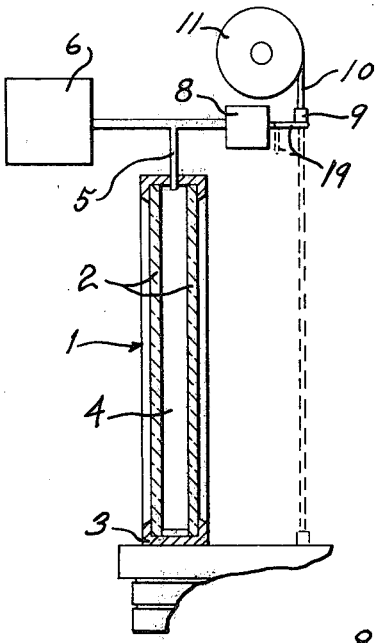
FIG. 1 is a schematic elevation view illustrating an application of the latching mechanism to a window shielding.
Figure 2:
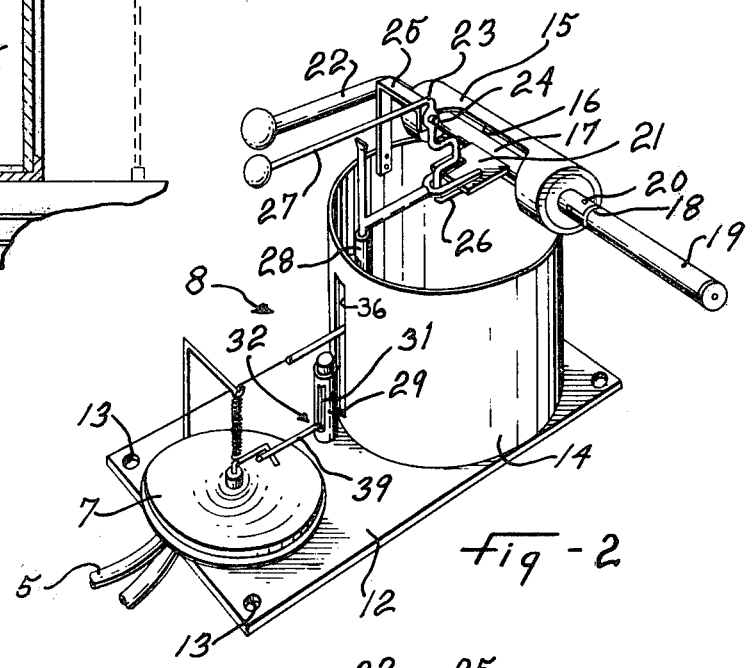
FIG. 2 is a perspective view of a latch mechanism in accordance with the invention.
Figure 3:
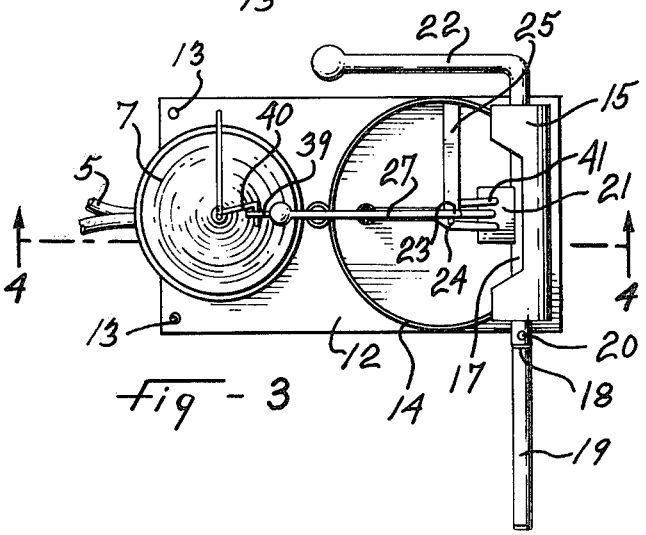
FIG. 3 is a top plan view of the latch mechanism of FIG. 2.

The illustrated anti-burglar window shielding system comprises a window 1, such as a show window, including a pair of laterally spaced-apart panes 2 held by a frame 3 forming an airtight space 4 between the panes. A fluid line 5 communicates at one end with the airtight space 4 of the window 1 and at the other end with a vacuum pump 6, an exit and a bellows 7, the latter forming part of a latch mechanism 8. This latch mechanism includes a latch pin adapted to intercept the weighted edge 9 of a shielding curtain 10 which is inoperatively held in a roll 11 extending lengthwise across the width of the window 1 at the top of the latter. Obviously, the release of the afore-mentioned latch pin will allow deployment or unrolling of the shielding curtain 10 under gravity, such that the latter will deploy to shield the entire surface of the window on the external side of the latter, as shown by the dotted line in FIG. 1. The shielding curtain 10 is preferably made of interconnected metal links, as known, to form an effective barrier against burglary.

The latch mechanism 8 will now be described in detail with reference to FIGS. 2 to 4*a* inclusive. The latch mechanism 8 includes a baseplate 12 adapted to be horizontally fixed on a structural member at the top of the window, such as by screws fixed in the holes 13. A horizontal tubular support 14 is secured endwise onto the baseplate 12. A tubular member 15 having a cutout 16 is rigidly secured on top of the tubular support 14 and extends transversely of the latter with the cutout 16 directed laterally toward the top opening of the tubular support and toward the bellows 7 secured on the baseplate 12.

A latch finger is rotatably mounted in the tubular member 15 about the longitudinal axis of the latter. This latch finger includes a spindle 17 or root portion providing the rotation about the longitudinal axis in the tubular member 15. The latch finger also includes a latch pin portion formed by a journal portion 18 and a sleeve 19 rotatable on the journal portion 18. The latter, and thus the latch pin portion as a whole, are pivoted at one end on an external end of the spindle 17 about an axis extending transversely of the longitudinal axis of the latch finger or spindle 17, as indicated by the pin 20. Preferably, the sleeve 19 is mounted on bearings relative to the journal portion 18 to facilitate the afore-mentioned rotation about the longitudinal axis.

The spindle 17 is provided with a radial projection 21 projecting outwardly through the cutout 16 and is also provided with an arm 22 which laterally weights the spindle relative to its axis to rotatively bias the spindle toward alignment of the pin 20 with the horizontal. A catch device, to be hereinafter described, is provided to catch the radial projection 21 and hold the latch finger in latched position. The catch device includes a crank lever 23 pivoted on a pin 24 secured to a bracket 25 attached to the tubular support 14. Thus, the crank lever 23 is pivotable about an axis extending parallel to the spindle 17. One arm of the crank lever forms a catching hook 26 and the other arm forms an actuation arm 27.

A trigger device is provided to actuate the catch device and includes a first and a second tubular guideways 28 and 29 having guide slots 30 and 31 therein respectively. The guide slot 31 is formed with a cocking notch, as shown at 32 in FIG. 2. A plunger 33 is upwardly slidable in the tubular guideway 28 and adapted to strike the actuation arm 27 when upwardly projected, as shown by the arrows 34 in FIG. 4*a*. The plunger 33 has a radial arm 35 outwardly projecting through the upright slot 30 of the tubular guideway 28 and an upright slot 36 in the tubular support 14. A plunger 37 is upwardly slidable in the tubular guideway 29 and is upwardly biased by a spring 38 at the bottom of this tubular guideway. The plunger 37 has a radial arm 39 outwardly projecting through the upright guide 31 of the tubular guideway 29.

An actuating arm, or wire 40, is secured to the bellows 7 to be upwardly displaced by the latter. The arm 40 has an inclined free end adapted to dislodge the radial arm 39 from the cocking notch of the slot 31 upon expansion of the bellows. This expansion occurs upon breaking of at least one pane 2 and the resultant loss of vacuum in the space 4.

Figure 4:
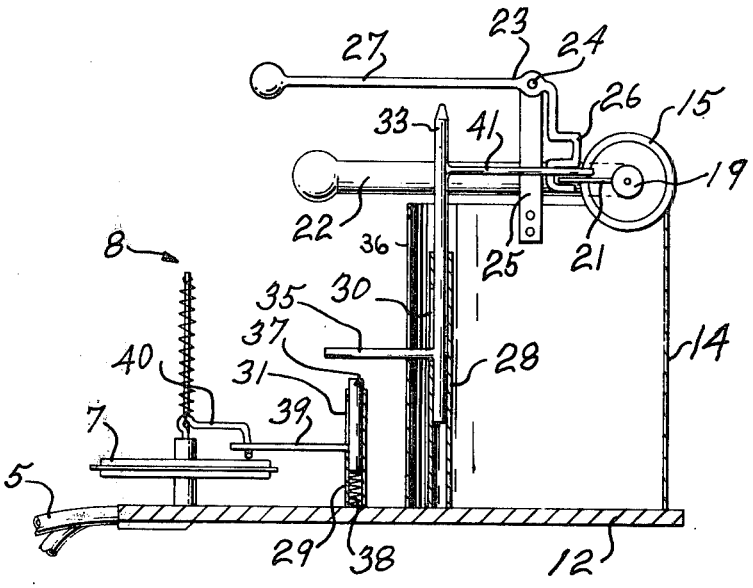
FIG. 4 is a cross-sectional view as seen along line 4—4 in FIG. 3 and showing the mechanism in latching position.
Figure 4A:
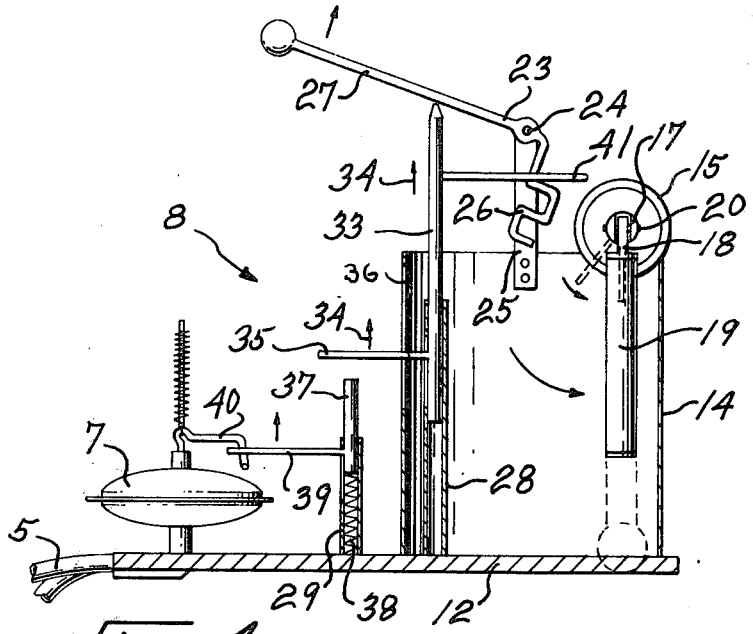
FIG. 4*a* compares to the view of FIG. 4 but with the mechanism in released or unlatched position.

The release of the arm 39 from the cocking notch allows the spring 38 to upwardly propel the plunger 37 which strikes the arm 35 and throws the plunger 33 against the actuation arm 27. A guide fork 41 radially projecting from the plunger 33 operatively straddles the catching hook 26 to guide the latter. The upward pivoting of the actuation arm 27 produces disengagement of the catching hook 26 from the radial projection 21. The weight of the radial arm 22 then pivots the latch finger about the longitudinal axis thereof toward horizontal alignment of the transverse axis defined by the pin 20. The latch pin portion including the sleeve 19 then pivotally drops to a downwardly hanging released position, as shown in FIG. 4*a* and in dotted line in FIG. 1. The shielding curtain 10 is thus released and allowed to deploy in front of the window.

It must be noted that the window may be a different type, such as, for instance, of the single pane type, in which case the required vacuum space, to replace space 4, could be formed by a tubular passage in the glass of the pane. Obviously, the latching mechanism of the present invention has other applications than the example illustrated and described.

What I claim is:

1. A latch mechanism comprising a support, a latch finger including a root portion and a latch pin portion freely pivotable at one end to one end of said root portion about a transverse axis relative to the longitudinal axis of said root portion, said root portion maintained horizontal by said support and rotatable therein about said longitudinal axis between a latching position in which said transverse axis is upright and said latch pin portion is maintained horizontal and in alignment with said root portion, and a releasing position in which said transverse axis is horizontal and said latch pin is allowed to freely pivot about said transverse axis to a downwardly hanging position, biasing means acting on said root portion to urge rotation of the latter in said support from said latching position to said releasing position, a catch device releasably holding said root portion in said latching position against the action of said biasing means and a trigger device selectively operating said catch device to cause the latter to release said root portion permitting rotation of the latter from said latching position to said releasing position under the action of said biasing means.

2. A latch mechanism as defined in claim 1, further including a bellows connected to said trigger device and constructed and arranged to operatively release the latter.

3. A latch mechanism as defined in claim 1, wherein said root portion has a radial projection releasably engageable by the catch device to hold said root portion in latching position.

4. A latch mechanism as defined in claim 3, wherein said biasing means includes a weight secured to and radially offset from said root portion.

5. A latch mechanism as defined in claim 4, wherein said weight includes an arm extending radially to said root portion and orthogonally relative to said transverse axis, and said latch pin portion includes a journal portion and a sleeve rotatable on said journal portion.

6. A latch mechanism as defined in claim 5, wherein said catch device includes a crank lever pivoted intermediate the opposite arms thereof about an axis extending transversely of the plane thereof and longitudinally of said longitudinal axis, one arm of said crank lever constitutes a catching hook releasably catching said radial projection and said trigger device operatively engages the other arm of said crank lever to pivot the latter in a direction to release said catching hook from engagement with said radial projection.

7. A latch mechanism as defined in claim 6, further including a bellows having a releasing finger displaceable therewith, said trigger device includes a first spring-loaded plunger, means to cock said spring-loaded plunger, the latter having an actuation finger radially projecting therefrom and operatively intercepting said releasing finger for actuation by the bellows.

8. A latch mechanism as defined in claim 6, further including a bellows having a releasing finger displaceable therewith and wherein said trigger device includes a first and a second plunger guideways each defining a guide slot extending longitudinally thereof and relative to each other, the guide slot of the first plunger guideway forms a cocking notch at one end thereof, first spring-loaded plunger and a second plunger slidable within said first and said second plunger guideways respectively, said first plunger having an actuation finger extending through the guide slot of the first plunger guideway and engageable into said cocking notch to cock said first plunger against the bias of its spring, said actuation finger operatively intercepting said releasing finger for uncocking of said first plunger by said bellows, said second plunger includes a radial projection outwardly extending through the slot of the second plunger guideway and arranged in the path of said first plunger, and said second plunger is aligned with said other arm of said crank lever and operatively thrown against the latter upon uncocking of said first plunger by the bellows.

* * * * *